US005564477A

United States Patent [19]

Probst

[11] Patent Number: 5,564,477

[45] Date of Patent: Oct. 15, 1996

[54] RIBBON LOOM WITH A WEFT INSERTION NEEDLE

[75] Inventor: Anton Probst, Frick, Switzerland

[73] Assignee: Textilma AG, Hergiswil, Switzerland

[21] Appl. No.: 367,284

[22] PCT Filed: Apr. 20, 1994

[86] PCT No.: PCT/CH94/00077

§ 371 Date: Jan. 12, 1995

§ 102(e) Date: Jan. 12, 1995

[87] PCT Pub. No.: WO94/26964

PCT Pub. Date: Nov. 24, 1994

[30] Foreign Application Priority Data

May 12, 1993 [DE] Germany ..... 9307233 U

[51] Int. Cl.[6] ..... D03D 47/06; D03D 47/10

[52] U.S. Cl. ..... 139/442

[58] Field of Search ..... 139/442, 22, 118

[56] References Cited

U.S. PATENT DOCUMENTS 4,541,461 9/1985 Villa ..... 139/442

4,562,868 1/1986 Jammes ..... 139/118

FOREIGN PATENT DOCUMENTS 2527899 8/1976 Germany ..... 139/22

1424301 2/1976 United Kingdom ..... 139/442

*Primary Examiner*—Andy Falik

*Attorney, Agent, or Firm*—Anderson Kill Olick & Oshinsky, P.C.

[57] ABSTRACT

A thread insertion needle for a ribbon weaving machine includes a needle body and a bracket, enclosing the needle body and having two parallel legs disposed on opposite sides of the needle body and forming with the needle body two slots, and a connector section connecting the two legs, with the connector being spaced from the needle body tip and defining with the body tip a free space for receiving therein filling threads for inserting them into a shed in addition to a filling thread received in the recess formed in the needle body tip.

3 Claims, 4 Drawing Sheets

RIBBON LOOM WITH A WEFT INSERTION NEEDLE

BACKGROUND OF THE INVENTION

1. Field of the Invention

The present invention deals with a filling thread insertion or shooting needle for a ribbon weaving machine as well as a ribbon weaving machine itself equipped with such a filling thread insertion needle.

Various embodiment forms of filling thread insertion needles are used in ribbon weaving machines.

2. Description of the Prior Art

In the group of embodiment forms of filling thread insertion needles (EP 0 121 648 B1, GB 1 424 301, GB 2 146 665 A) a hook exists for gripping the filling thread to be inserted and a thread guide is provided for additional filling threads. The thread guiding is accomplished through a slot, which extends essentially across the length of the needle. This slot can be configured within the needle or can be formed by the needle body and a second member connected therewith. These embodiment forms have the following disadvantages in common: that the guidance is disposed either above or below the needle body and consequently the filling threads, which do not have to be inserted cannot form a shed and are carried along loosely similar to warp threads and also that a filling thread, which is not inserted over a larger distance, floats and becomes visible at the edge of the fabric. This can indeed be partially prevented in that blind fillers are inserted, which is disadvantageous, since the overall productivity is thereby reduced, meaning the weaving output is lower and the thread consumption is greater. In addition such blind fillers can impair the appearance of the fabric, in particular because loose dark figure or fancy threads appear as being translucent through light color weaves.

In another group of embodiment forms the filling thread insertion or shooting needles have only a hook at the needle tip, which is configured on the needle at the bottom or the top. A guidance has not been provided. In these embodiment forms the shedding motion of the non-inserted filling threads is possible. In this case it is disadvantageous that the filling thread can be inserted only on one side, which excludes the so-called pic-pic, and that a special laying-in device is required, whereby the weaving speed is reduced because of the extremely rapid laying-in and picking-out motion.

Finally filling thread insertion or shooting needles are known (CH 16 654 A5), which comprise a fork-shaped recess at the needle tip for gripping the filling thread to be inserted. With this filling thread insertion needle any desired filling change is possible wherein however the following disadvantages have to be accepted:

1. Sticking and crossed warp threads, which get into the effective range of the fork, are carried along as filling threads. Weaving errors and warp thread breaks consequently occur.
2. The inserted filling thread is not pulled back by the needle since the fork is open towards the tip of the needle. Due to this a higher filling thread tension must be provided which tends to increase the filling thread breaks.

Both above phenomena have a disadvantageous or negative effect upon the productivity of the ribbon weaving machine.

SUMMARY OF THE INVENTION

The invention wants to remedy or redress this state of affairs. The invention solves this task, by inserting or shooting one single filling thread out of a number of the filling threads guided in the filling thread insertion needle and by forming a shed out of the remaining filling threads.

The invention affords expediently the possibility

- of any random filling change pic a pic, meaning from above and below the needle body;
- to tie the non-inserted filling threads such as warp threads into the edge of the weave or tissue, thus making them invisible;
- to control the reading-in of the filling thread and the shedding motion by a conventional Jacquard apparatus;
- to use a color control device directly as a shedding motion device without using any special motion sequence;
- to tension of the lastly inserted filling thread and to produce a fine impeccably tensioned stitch edge.

BRIEF DESCRIPTION OF THE DRAWINGS

In the following the invention is described with the help of the enclosed drawings. It is shown on.

DETAILED DESCRIPTION OF THE PREFERRED EMBODIMENTS

Figure 1:
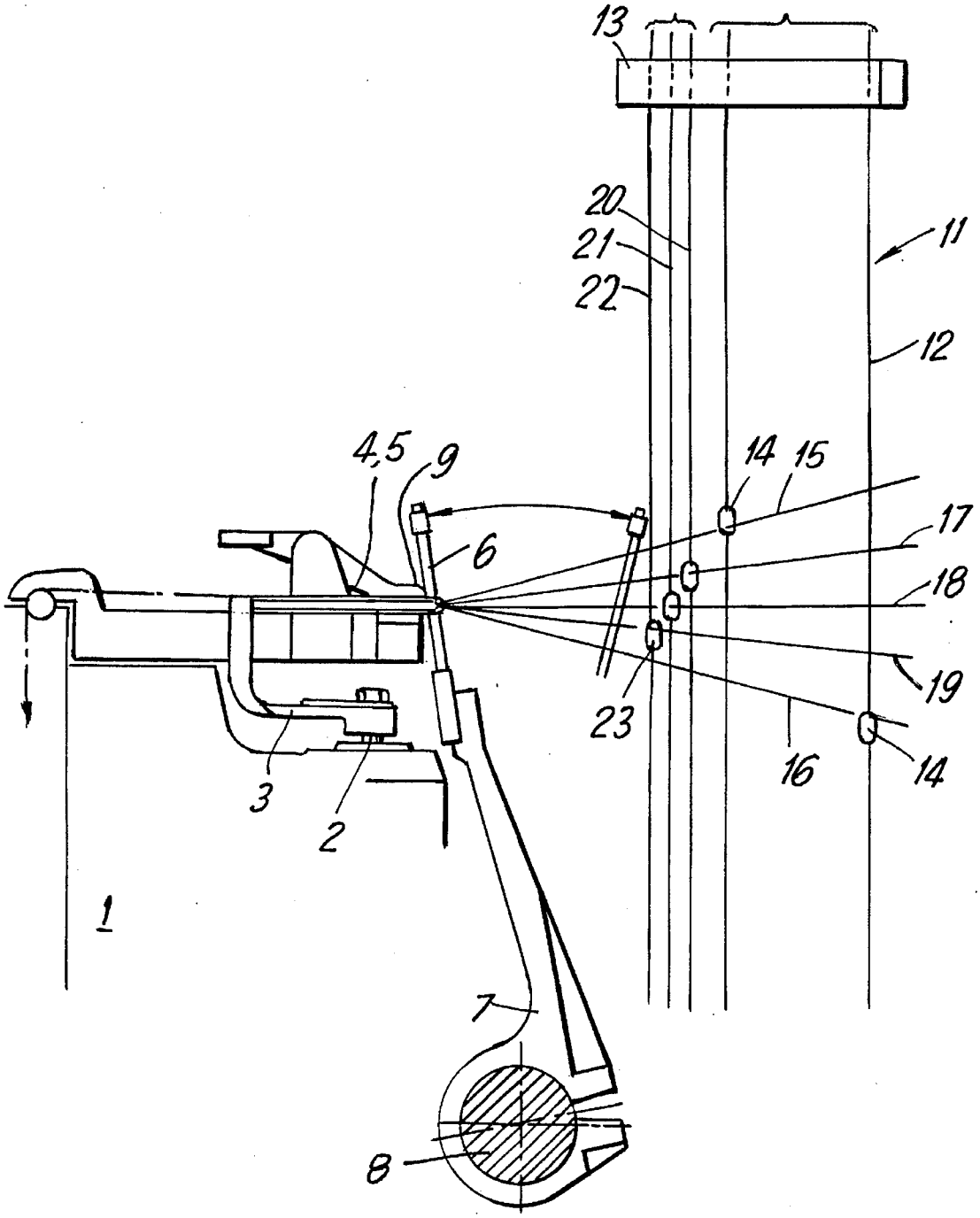
FIG. 1 a diagram of a portion of a weaving machine in side view.

A driving device with an oscillating shaft 2 is provided at the frame 1 of the weaving machine, at which shaft an arm 3 for a filling thread insertion needle 4, 5 for insertion of filling threads into a weaving shed formed by the warp threads 15, 16 is fastened. A reed 6 is connected to a drive shaft 8 through a drive lever 7 and performs a reciprocating pivoting motion, in order to beat-up or loop an inserted filling thread to the setting-on edge.

Figure 2:
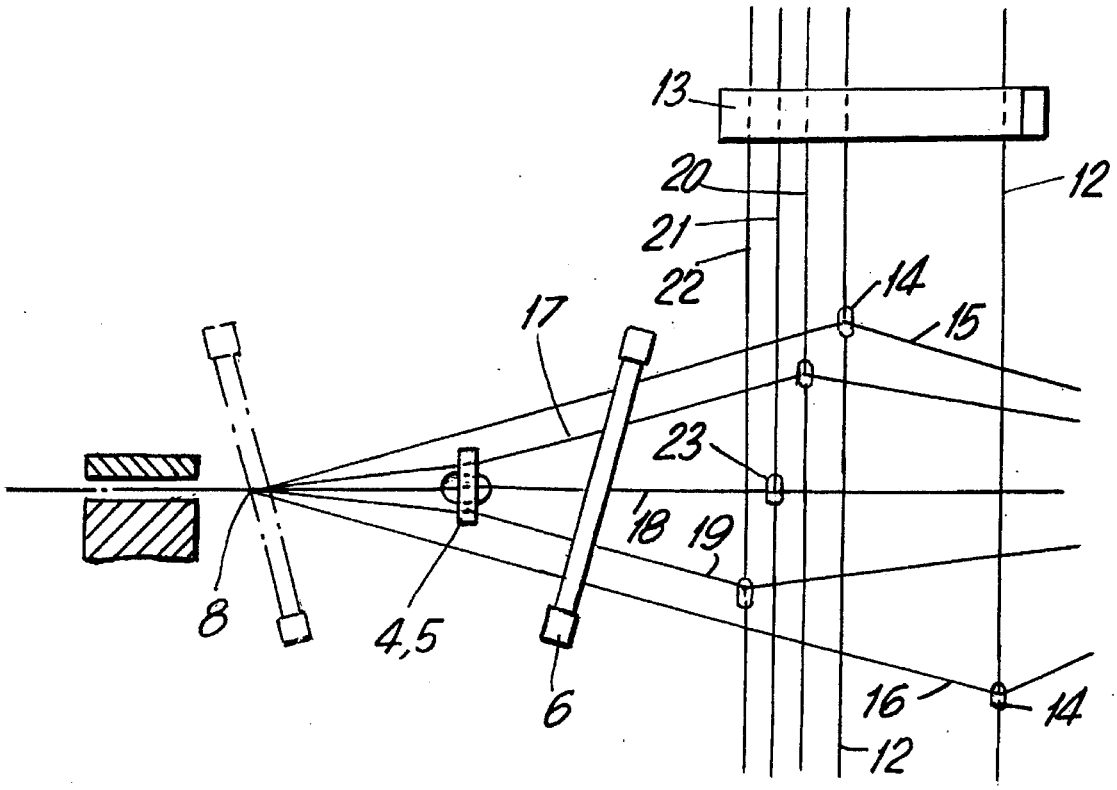
FIG. 2 a presentation of a shed of the weaving machine in FIG. 1 during insertion of a filling thread.

A shedding motion device 11 contains heddles 12 which are guided and aligned by harness or camber board 13. The heddles 12 comprise thread guides 14 by means of which the warp threads 15, 17 are moved up and down in accordance with a preset program in order to form a weaving shed (FIG. 2). As is shown in FIGS. 1 and 2, filling threads 17, 18, 19 are furthermore provided, which are movable up and down by the heddles 10, 21 and 22 with the thread guides 23, in order to select the filling thread 18 intended for insertion or shooting into the shed. This filling thread 18 is thereby guided into the path of motion of the filling thread insertion needle 4, 5 and after insertion it is beat up by the reed at the edge of the weave 9.

As FIGS. 3 to 6 show, the filling thread insertion needles 4, 5 consist of a needle body and a bracket, which are fastened to the arm 3 in a cantilevered manner. The needle bodies have a V-shaped recess 30 at the free end.

Figure 3:
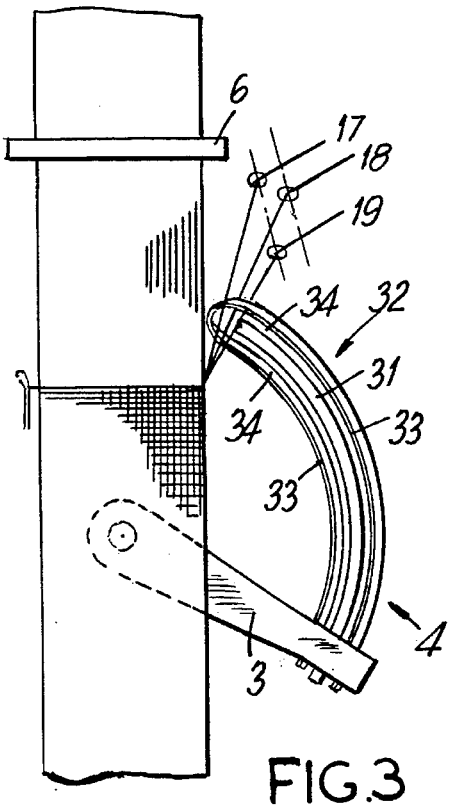
FIGS. 3 to 5: an embodiment form of a filling thread insertion needle in the invention in the course of filling thread insertion in three positions, shown diagrammatically.
Figure 4:
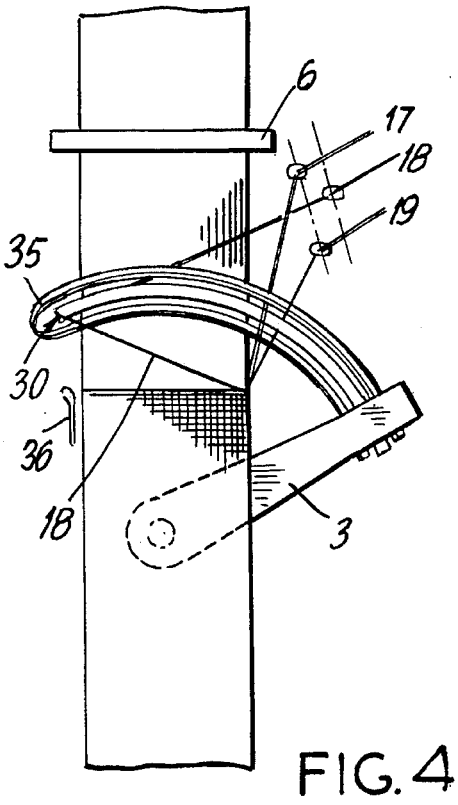
Figure 5:
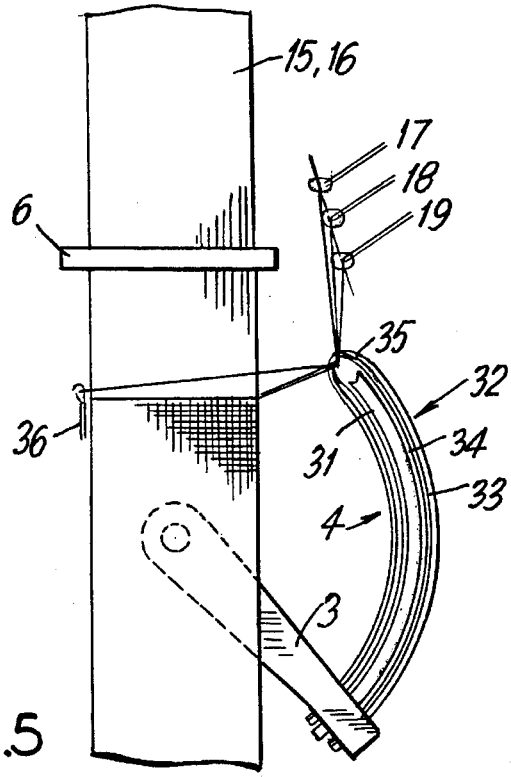

In the embodiment form shown in FIGS. 3 to 5 the needle body 31 is shaped like a circular arc and the curved bracket 32 has two legs 33 extending in a parallel manner. The bracket is connected with its leg ends in the arm and encloses the needle body 31 in such a way, that a slot 34 exists respectively between the needle body 31 and the legs 33 and spacing is provided between the free end of the needle body, 31 and the connecting segment or section 35. The curved bracket 32 is formed advantageously of a wire. The filling thread insertion needle 4 is disposed in such a way in the arm 3, that the opening plane of the slots 34 lies transversely to the plane of motion of the filling thread insertion needle 4 (FIG. 2).

The mode of operation of the filling thread insertion needle 4 is described with reference to FIGS. 3 to 5 at the example of three filling threads 17, 18, 19. The filling thread insertion needle 4 is shown in FIG. 3 in a position prior to insertion into the shed. Prior to the insertion the filling thread 18 to be inserted is displaced by means of the heddle 21 (FIG. 2) into the path of motion of the needle body 31, so that during the insertion motion the filling thread 18 can be placed into the V-shaped recess 30 and can be gripped there by the needle body 31. During the filling thread insertion only the selected filling thread 18 is pulled through the shed formed by the warp threads, 15, 16, while the filling threads 17, 19, which have not been gripped, are conducted separately from each other respectively into a slot 34 along the needle body 31 and form a shed (FIG. 2). In the position shown in FIG. 4 the filling thread insertion needle 4 has pulled the filling thread 18 through the shed in order to transfer it to a diagrammatically shown tie-up device 36. Subsequently the filling thread insertion needle 4 is pulled out of the shed and assumes the position shown in FIG. 5. In the course of this motion the remaining filling threads 17, 19 are pulled to the side in the final phase, so that the inserted filling thread 18 can subsequently be looped or beaten up by the reed 6.

Figure 6:
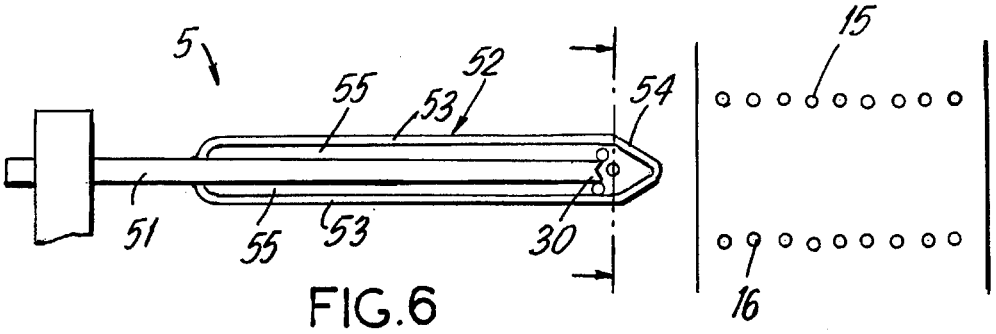
FIG. 6 and 7: another embodiment form of a filling thread insertion needle during filling thread insertion shown in two positions.
Figure 7:
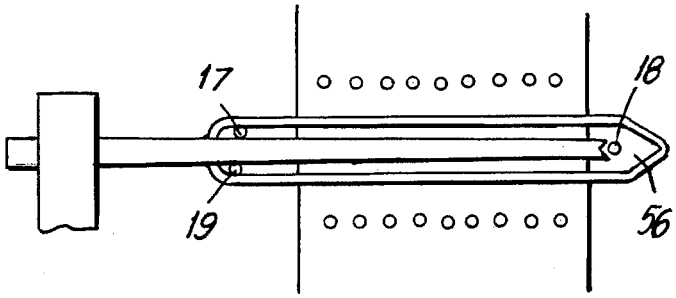

Another embodiment form of a filling thread insertion needle 5 is shown in FIGS. 6 and 7, wherein the filling thread insertion needle is shown in FIG. 6 in a position prior to the start of the insertion process and is shown in FIG. 7 in the position after termination of the insertion process.

The filling thread insertion needle 5 has the same basic structure as the filling thread insertion needle 4. The filling thread insertion needle 5 consists of a straight needle body 51 and a bracket 52 with two straight legs 53 and a V-shaped connector segment 54. The bracket 52 is fastened with its free ends to the needle body 51 in such a way, that a straight slot 55 exists respectively between the needle body 51 and the legs 53 and that a spacing exists between the free end of the needle body 51 and the connector segment 54.

The mode of operation of this filling thread insertion needle 5 is the same as in the case of the filling thread insertion needle 4 described in connection with FIGS. 3 to 5, so that a detailed description thereof does not need to be given.

I claim:

1. A thread insertion needle for a ribbon weaving machine for inserting a plurality of filling threads, the thread insertion needle comprising:

a needle body having a tip and a recess formed in the tip for receiving one of the plurality of filling threads; and a bracket enclosing the needle body and having two parallel legs disposed on opposite sides of the needle body and forming therewith two slots, and a connector section connecting the two legs, the connector section being spaced from the tip and defining therewith a free space for receiving therein other of the plurality of filling threads.

2. A ribbon waving machine, comprising a thread insertion needle for inserting a plurality of filling threads, said needle having:

a needle body having a tip and a recess formed in the tip for receiving one of the plurality of filling threads, and a bracket enclosing the needle body and having two parallel legs disposed on opposite sides of the needle body and forming therewith two slots, and a connector section connecting the two legs, the connector section being spaced from the tip and defining therewith a free space for receiving therein other of the plurality of filling threads; and means for reciprocating the thread insertion needle for inserting the plurality of filling threads into a shed, and wherein an opening plane of the two slots lies transversely to a motion plane of the thread insertion needle.

3. A ribbon weaving machine according to claim 2, further comprising tie-up means for tying up the filling threads, wherein the connector section tensions the filling threads upon exiting of the thread insertion needle from the shed to facilitate tying up of the threads.

* * * * *